US008643264B2

(12) United States Patent
Nishiuchi et al.

(10) Patent No.: US 8,643,264 B2
(45) Date of Patent: Feb. 4, 2014

(54) ILLUMINATING DEVICE

(71) Applicant: Kabushiki Kaisha Toshiba, Tokyo (JP)

(72) Inventors: Hideo Nishiuchi, Hyogo-ken (JP); Izuru Komatsu, Kanagawa-ken (JP); Daigo Suzuki, Kanagawa-ken (JP); Kazuki Tateyama, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/622,952

(22) Filed: Sep. 19, 2012

(65) Prior Publication Data

US 2013/0070457 A1 Mar. 21, 2013

(30) Foreign Application Priority Data

Sep. 20, 2011 (JP) ..... 2011-204898

(51) Int. Cl.
*H01J 1/62* (2006.01)

(52) U.S. Cl.
USPC ..... 313/493; 313/634; 313/635

(58) Field of Classification Search
USPC ..... 313/512, 498, 634, 635, 493
See application file for complete search history.

(56) References Cited

U.S. PATENT DOCUMENTS

2011/0101842 A1* 5/2011 Valenzano ..... 313/46

FOREIGN PATENT DOCUMENTS

| | | |
|---|---|---|
| JP | 2001-067910 | 3/2001 |
| JP | 2003-059305 | 2/2003 |

* cited by examiner

*Primary Examiner* — Vip Patel
(74) *Attorney, Agent, or Firm* — Patterson & Sheridan, L.L.P.

(57) ABSTRACT

According to one embodiment, the illuminating device of the embodiment has a base part and multiple light emitting elements; the illuminating device includes a supporting part, which is arranged on one end of the base part, and which at least partially encloses an internal space. The supporting part also has an outer surface exposed to the ambient atmosphere. The multiple light emitting elements are disposed on the inner surface side of the supporting part so that at least light emitting surfaces of the light emitting elements are in contact with the supporting part.

6 Claims, 10 Drawing Sheets

ILLUMINATING DEVICE

CROSS-REFERENCE TO RELATED APPLICATION

This application is based upon and claims the benefit of priority from Japanese Patent Application No. 2011-204898, filed Sep. 20, 2011; the entire contents of which are incorporated herein by reference.

FIELD

Embodiments described herein generally relate to an illuminating device.

BACKGROUND

In recent years, instead of incandescent light bulbs (filament light bulbs), illuminating devices which employ light emitting diodes (LEDs) as a light source have been adopted for practical applications.

Illuminating devices which use light emitting diodes have a longer lifetime and a lower power consumption, and for this reason, are expected to replace the existing incandescent light bulbs.

However, when light emitting diodes are used as the light source, the light distribution angle is narrower than that of incandescent light bulbs. This is undesirable.

In consideration of this problem, people have proposed an illuminating device having an expanded light distribution angle resulting from the arrangement of multiple light emitting diodes on a curved printed circuit board. However, for such an illuminating device, the ability to dissipate heat generated by the multiple light emitting diodes is poor. This poor heat dissipation limits the electric power that can be applied to the illuminating device for the production of light. Thus, the light output from the light emitting diodes may become less intense and the emission of light from the illuminating device is less than optimal.

DESCRIPTION OF THE DRAWINGS

FIG. 1A shows the illuminating device equipped with a supporting part which does not have an opening portion. FIG. 1B shows an illuminating device equipped with a supporting part having an opening portion formed therein.

FIG. 2A shows the illuminating device equipped with a supporting part which does not have an opening portion. FIG. 2B shows the illuminating device equipped with a supporting part with an opening portion formed thereon, the opening portion located at an end of the base part.

FIG. 4A shows the illuminating device equipped with a supporting part which does not have an opening portion. FIG. 4B shows the illuminating device equipped with a supporting part having an opening portion therein, the opening portion located at an end of the base part.

FIG. 6A shows the case of a conventional illuminating device. FIG. 6B shows an illuminating device having the heat dissipating part shown in FIG. 4. FIG. 6C shows the illuminating device having the heat dissipating part and the opening portion shown in FIG. 5.

DETAILED DESCRIPTION

Figure 1A:
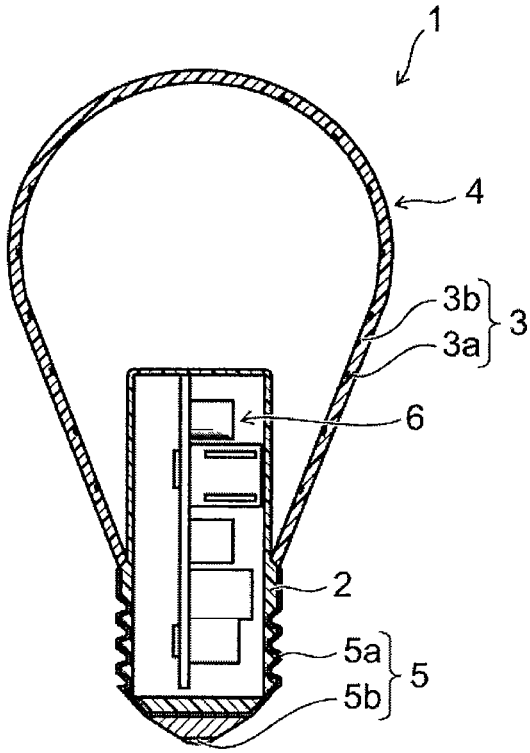
FIGS. 1A and 1B are schematic cross-sectional views illustrating an example of an illuminating device of an embodiment.

In general, embodiments will be described with reference to the figures. The same reference numerals will be used in different figures to refer to the components that are common throughout the figures, and these common components will not be explained in detail.

According to an embodiment, there is provided an illuminating device with improved heat dissipation properties.

The illuminating device related to the embodiment has a base part and multiple light emitting elements. The illuminating device also has a supporting part, which is arranged on one end of the base part, an internal space, and an outer surface exposed to the ambient atmosphere. The multiple light emitting elements are disposed on the interior side of the supporting part so that at least a portion of the light emitting surfaces thereof are in contact with the supporting part.

Figure 1B:
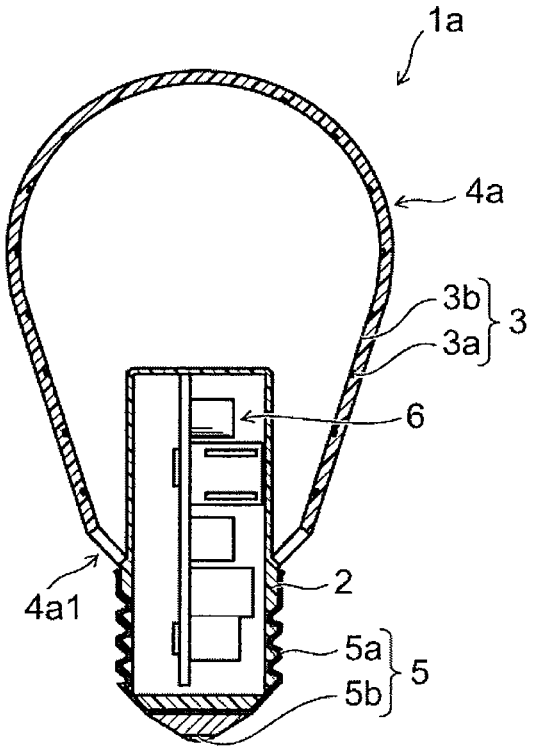

FIGS. 1A and 1B are schematic cross-sectional views illustrating an example of an illuminating device according to one embodiment.

FIG. 1A shows an illuminating device 1 equipped with a supporting part 4 without an opening portion and FIG. 1B shows an illuminating device 1*a* equipped with a supporting part 4*a* having an opening portion 4*a*1 (corresponding to an example of a first opening portion) on the side facing a base part 5.

Figure 2A:
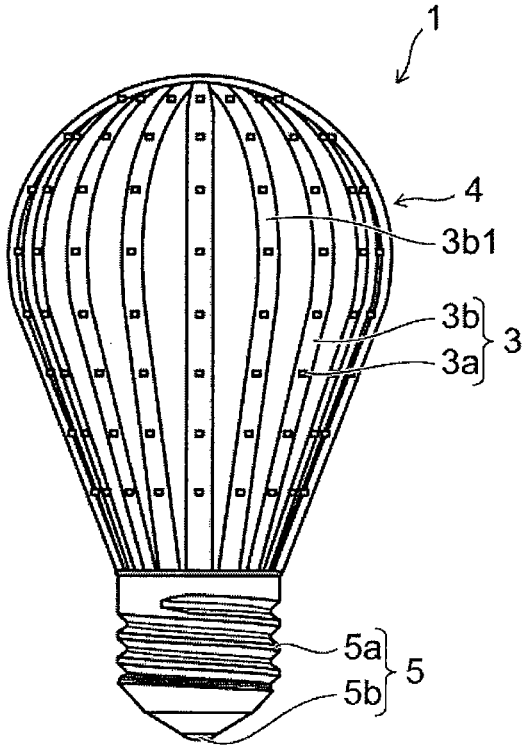
FIGS. 2A and 2B are schematic views illustrating an example of a light source.
Figure 2B:
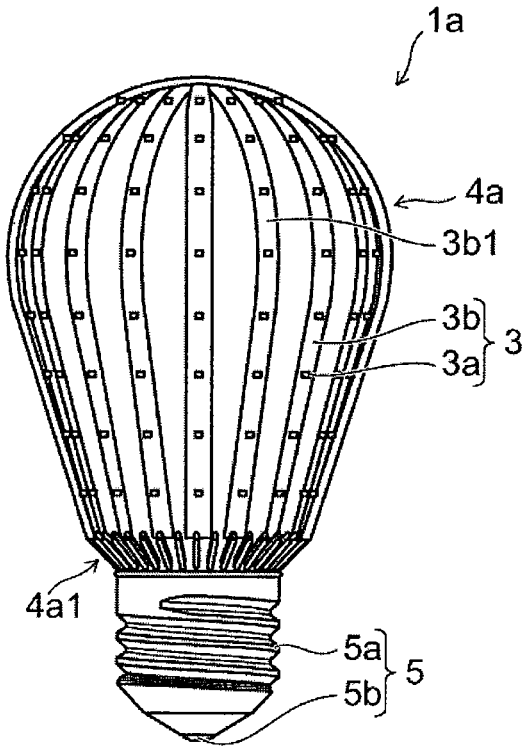

FIGS. 2A and 2B are schematic diagrams illustrating an example of a light source part 3 of the illuminating devices 1 and 1*a*, respectively, shown in FIGS. 1A and 1B.

In addition, FIG. 2A shows the illuminating device 1 equipped with a supporting part 4 which is not configured with an opening portion, and FIG. 2B shows the illuminating device la having a supporting part 4*a* having an opening portion 4*a*1 at an end thereof which faces the base part 5.

Additionally in FIGS. 1A and 1B, the illuminating devices 1 and 1*a* have a main body part 2, a light source part 3, a supporting part 4, a base part 5, and a control part 6.

The main body part 2 has an internal space that can accommodate the control part 6.

One end portion of the main body part 2 resides within the base part 5. In this case, the side surface of one end portion of the main body part 2 can be anchored to the inner wall surface of the base part 5.

There is no specific restriction on the material of the main body part 2. In consideration of dissipation of the heat generated in the control part 6, it is preferred that the main body part 2 be made of a material with a high thermoconductivity.

Examples of materials with high thermoconductivity include aluminum (Al), copper (Cu), iron (Fe), nickel (Ni), alloys thereof, and other metal materials. However, the present embodiment is not limited to these materials. Inorganic materials such as aluminum nitride (AlN), silicon carbide (SiC), and organic materials such as high-thermoconductivity resins, etc. may also be adopted.

As shown in FIGS. 1A-2B, light emitting elements 3*a* and a substrate part 3*b* are arranged in the light source part 3.

The light emitting elements 3*a* may be, for example, light emitting diodes, organic light emitting diodes, laser diodes, or other so-called spontaneous light emitting elements. Multiple light emitting elements 3*a* are arranged on the substrate part 3*b*. In this case, the light emitting elements 3*a* may be arranged in a regular configuration of an array, such as a configuration with equal spacing, or they may be arranged in any configuration.

That is, the light emitting elements 3*a* may be dispersed on the interior surface of the supporting part 4, and may be placed on the supporting part 4 such that at least a light emitting surface (exit plane) of each light emitting element is in contact with the supporting part 4. In this case, in order to have the heat that is generated in the light emitting elements 3*a* transferred at a high efficiency to the supporting part 4, the light emitting elements 3*a* are at least partially embedded in the supporting part 4, as well as being dispersed over the inner surface side of the supporting part 4.

The substrate part 3*b* can have a wiring pattern not shown in the figure. Furthermore, the light emitting elements 3*a* and control part 6 are electrically connected via a wiring pattern which is also not shown in the figure. With regards to the construction of the substrate part, the substrate part 3*b*, for example, can be a flexible substrate or other substrate which facilitates assembly of the light emitting elements 3*a*.

The substrate part 3*b* is arranged to extend in the axial direction of the illuminating device 1. The substrate part 3*b* may also be composed of multiple belt-shaped portions arranged individually or connected with each other. For example, the substrate parts 3*b* may be formed by several individual belts coming together at one end of the illuminating device, where they are connected with each other.

Curvature is formed in the substrate near the end of the light emitting device opposite to the side facing the base part 5.

There is no specific restriction on the appearance and shape of the multiple substrate parts 3*b*. For example, the general shape of the multiple substrate parts 3*b* may be similar to, or different than that of the globe of a conventional incandescent light bulb similar to the embodiments shown in FIGS. 2A and 2B.

The supporting part 4 is disposed so as to cover at least the light emitting surface formed by the light emitting elements 3*a*.

The supporting part 4 is attached to base part 5 at one end thereof. The supporting part 4 may partially or completely enclose an internal space, and its exterior surface is exposed to the ambient atmosphere.

There is no specific restriction on the shape of the supporting part 4. For example, when the multiple substrate parts 3*b* are formed in a shape similar to that of the globe of a conventional incandescent light bulb, the shape of the supporting part 4 can be formed in a similar shape which provides a housing to cover the multiple substrate parts 3*b*.

The supporting part 4 can be formed using a light transmissive material. Examples of light transmissive materials include, for example, light transmissive resin materials such as silicone resin, polycarbonate, and inorganic materials such as glass, and light transmissive ceramics.

Also, the supporting part 4 may contain a diffusing agent that can diffuse light emitted from the light emitting elements 3*a*. Examples of the diffusing agents that may be used include fillers such as silicon oxide, metal oxide, and the like, micro particles of polymers, etc. As the diffusing agent is contained in the supporting part 4, the light emitted from the light emitting elements 3*a* can be diffused, thereby decreasing the unevenness in luminance.

The base portion of the supporting part 4, corresponding to the end of the supporting part 4 where base part 5 is located, may be anchored to the main body part 2.

Also, as in the illuminating device 1*a* shown in FIGS. 1B and 2B, multiple opening portions 4*a*1 are formed on the end portion of the supporting part 4*a*, near where the supporting part 4A is attached to the base part 5. The multiple opening portions 4A1 provide fluid communication between the internal space of the supporting part 4*a* and areas external to the illuminating device 1. The opening portions 4*a*1 enable external air to be drawn into the interior of the supporting part 4*a*, and/or enable the air inside the supporting part 4*a* to be exhausted through the opening portions 4*a*1.

The base part 5 is disposed around an end of the main body part 2 which is opposite to the end to which the supporting part 4 is attached. The base part 5 may have a shape that allows it to be attached in a socket suitable for the attachment of an ordinary incandescent light bulb. For example, the base part 5 may have a shape similar to the E26 shape or E17 shape defined in the JIS standard, as well as other standards used throughout the world. Here, the shape of the base part 5 is not limited to the shape shown in the example, and appropriate changes can be adopted. For example, the base part 5 may also have a pin-shaped terminal of the type used for fluorescent lamps. Also, it may have an L shaped terminal adopted for hooked ceiling lamps.

The base part 5, for example, may be formed using an electrically conductive material such as a metal. Alternatively, the portion which connects with the external power supply may be formed from an electrically conductive material such as a metal, while the remaining portion is formed from a resin or the like.

The base part 5 shown as an example in FIGS. 1A and 1B and 2A and 2B, has a threaded cylindrical-shaped shell part 5*a*. The base part 5 also has an eyelet part 5*b* arranged on the end of the threaded cylindrical-shaped shell part 5*a* facing away from supporting part 4. The shell part 5*a* and the eyelet part 5*b* are electrically connected with the control part 6, which will be explained later. Consequently, electrical connection can be made between an external power supply (not shown in the figure) and the control part 6 via the shell part 5*a* and the eyelet part 5*b*. In the case where the main body part 2 is made of metal or the like, an insulating part made of an adhesive or the like is arranged between the main body part 2 and the base part 5.

The control part 6 is arranged in the internal space of the main body part 2. An insulating part not shown in the figure is arranged appropriately between the main body part 2 and the control part 6 to realize electrical insulation.

The control part 6 may have a control circuit that supplies electric power to the light source part 3. In this case, for example, the control circuit converts the commercial AC power supply, for example 100VAC to 120VAC, to DC power that is fed to the light source part 3. Also, the control part 6 may have a light adjusting circuit that adjusts the light of the light source part 3. In this case, the light adjusting circuit can perform light adjustment for each of the light emitting elements or for each of the group of light emitting elements.

In the illuminating devices 1 and 1*a* shown in FIGS. 1A-2B, heat is generated in the light emitting elements 3*a* and the control part 6 during operation of the illuminating devices 1 and 1*a*.

In this case, the heat generated from the light emitting elements 3*a* is dissipated to the exterior via supporting parts 4 and 4*a*.

On the other hand, the heat generated in the control part 6 is dissipated to the outer side via the main body part 2 and the base part 5.

Consequently, in the illuminating devices 1 and 1*a*, the heat dissipation route associated with light emitting elements 3*a* and the heat dissipation route associated with the control part 6 can be isolated from each other. Also, as multiple opening portions 4*a*1 are formed at the end of supporting part 4*a* near base part 5, it is possible to decrease heat conduction between the supporting part 4*a* and the main body part 2. By decreasing dissipation of heat of the control part 6 to the light emitting elements 3*a*, it is possible to proportionally reduce the temperature of the light emitting elements 3*a*.

In the illuminating devices 1 and 1*a*, the light emitting elements 3*a*, which develop heat as light sources, are dispersed on the supporting parts 4 and 4*a* in order to lessen heat density.

Also, in the illuminating devices 1 and 1*a*, supporting parts 4 and 4*a* are arranged between the light emitting elements 3*a*, which develop heat as light sources, and the ambient atmosphere. This arrangement enables a reduction of the thermal resistance between the light emitting elements 3*a* and the ambient atmosphere, which increases thermal conduction between the light emitting elements 3*a* and ambient atmosphere.

In the illuminating devices 1 and 1*a*, the heat generated in the light emitting elements 3*a* is dissipated to the exterior via supporting parts 4 and 4*a*. Consequently, in the illuminating devices 1 and 1*a*, the surface of the supporting parts 4 and 4*a* can serve as the heat dissipation surface.

Also, for the illuminating device 1*a*, as multiple opening portions 4*a*1 are arranged on the end of supporting part 4*a* that faces base part 5, the internal air of the supporting part 4*a* and ambient air from the atmosphere can flow therein.

Consequently, for the illuminating devices 1 and 1*a*, it is possible to improve the ability of the light emitting elements 3*a* to dissipate heat to the internal air surrounded by the supporting parts 4, 4*a* so that the heat may eventually transferred to the exterior of the illuminating device 1*a* through the supporting parts 4, 4*a*. As a result, in the illuminating devices 1 and 1*a*, it is possible to increase the electric power that can be provided to the light emitting elements 3*a*. Through increasing power in this manner, the light emission from the illuminating devices 1 and 1*a* may be enhanced.

However, as in the case of a conventional illuminating device using light emitting elements in the light source portion, if the light emitting surface is disposed perpendicular to the axial direction of the illuminating device, the light distribution angle becomes narrower than that of a conventional incandescent light bulb.

In contrast, for the illuminating devices 1 and 1*a*, the dispersed arrangement of light emitting elements 3*a* on the supporting parts 4 and 4*a* and the axially oriented position of the substrate parts 3*b*, enable the light distribution angle to be increased, thus providing enhanced light emission from the illuminating devices 1 and 1*a*.

Figure 3:
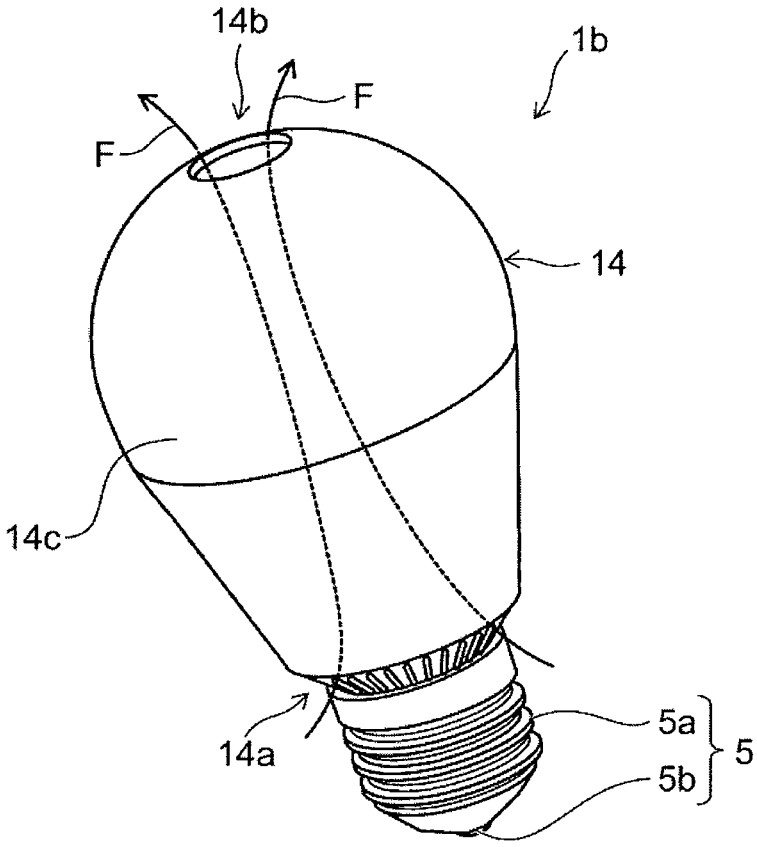
FIG. 3 is a perspective diagram illustrating an example of an illuminating device according to another embodiment.

FIG. 3 is a perspective diagram illustrating an example of the illuminating device related to an additional embodiment of the present disclosure.

The illuminating device 1*b* shown as an example in FIG. 3 has the same main elements as those of the illuminating devices 1 and 1*a*. Here, on the supporting part 14 arranged on the illuminating device 1*b*, opening portions 14*a* and opening portion 14*b* (corresponding to an example of a second opening portion) are provided. In addition, the supporting part 14 is the same as the supporting part 4*a* shown previously, with the exception of opening portion 14*b* which is formed only in supporting part 14.

Multiple opening portions 14*a* are arranged at the first end of the supporting part 14 adjacent the base part 5, and there is effectively no interruption between the internal space partially enclosed by supporting part 14 and the space external to the illuminating device 1*b*.

The opening portion 14*b* is arranged at the second end of supporting part 14 which faces away from the base part 5. This opening portion 14*b* provides further fluid communication between the internal space partially enclosed by supporting part 14 and the ambient environment external to the supporting part 14 of illuminating device 1*b*.

The shape, configuration, position, number and size, etc., of the opening portions 14*b* are not limited to the example shown in FIG. 3, and appropriate changes can be made.

For example, the supporting part 14 may have opening portions 14*a* and opening portion 14*b* which are separated from each other in the axial direction of the illuminating device 1*b*.

Alternatively, multiple opening portions 14*b* may be formed on the side surface 14*c* of the supporting part 14.

Multiple opening portions 14*b* with a small size may also be formed.

In order to suppress invasion of particles from the opening portions 14*b* into the supporting part 14, a lid or filter (not shown in the figure) which is permeable to air may be disposed upon each of the opening portions 14*b*. For example, a mesh-shaped lid may be arranged on the opening portions 14*b*.

For the illuminating device 1*b*, just as for the illuminating devices 1 and 1*a*, heat dissipation properties can be improved, and the light distribution angle can be increased.

In this case, for the illuminating device 1*b*, opening portions 14*a* and opening portions 14*b* are located apart from each other. Consequently, it is possible to form an air flow F inside the supporting part 14. The air flow F facilitates further improvements of the heat dissipation properties at the sides of light emitting elements 3*a*. Also, because increased power may be provided to the light emitting elements 3*a*, it is possible to further improve the light emission from the illuminating device 1*b*. In addition, the air flow direction in the supporting part 14 may be changed by adjusting the direction of attachment of the illuminating device 1*b*. For example, as shown in FIG. 3, air may enter through the opening portions 14*a* and exhausted from opening portion 14*b*. Also, air may enter through the opening portion 14*b* and exhausted from the opening portions 14*a*.

Figure 4A:
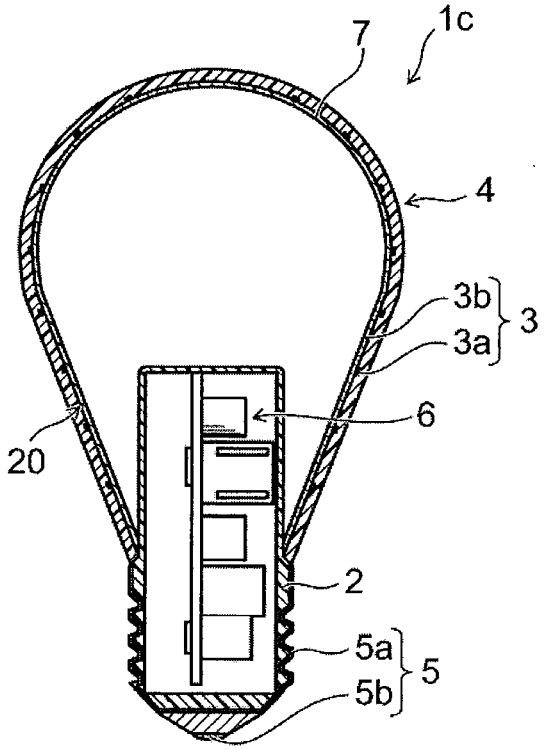
FIGS. 4A and 4B are perspective diagrams illustrating an example of the illuminating device according to another embodiment.
Figure 4B:
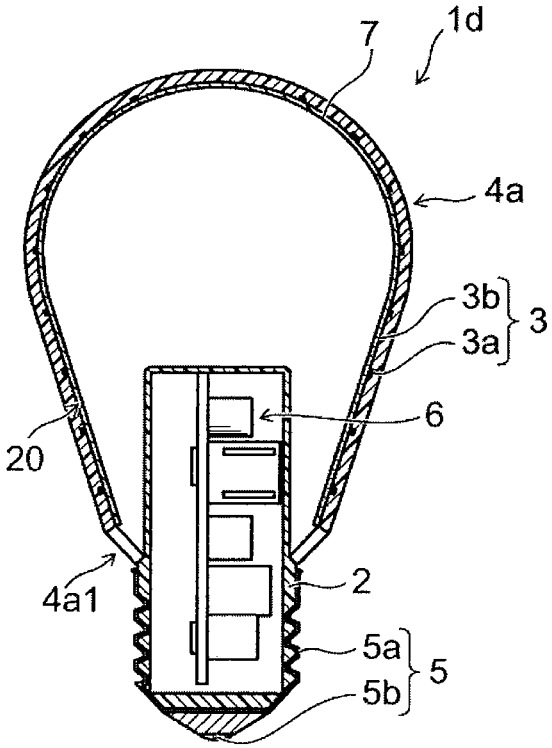

FIGS. 4A and 4B are schematic cross-sectional views illustrating an example of the illuminating device related to another embodiment.

FIG. 4A shows an illuminating device 1*c* equipped with a supporting part 4 not having an opening portion disposed thereon, and FIG. 4B shows an illuminating device 1*d* equipped with a supporting part 4*a* with an opening part 4*a*1 formed on a first end thereof adjacent the base part 5.

The illuminating devices 1*c* and 1*d* shown in FIGS. 4A and 4B, just as for the illuminating devices 1 and 1*a*, the following parts are included: a main body part 2, a light source part 3, supporting parts 4 and 4*a*, a base part 5, and a control part 6. In addition, for the illuminating device 1*c*, a heat dissipating part 7 is arranged on an interior surface of the supporting part 4.

The heat dissipating part 7 dissipates the heat generated by light emitting elements 3*a*. Consequently, the heat dissipating part 7 should be made of a material with a high thermoconductivity.

Example materials with high thermoconductivity include metal materials such as aluminum (Al), copper (Cu), iron (Fe), nickel (Ni), and alloys thereof. However, the present embodiment is not limited to these materials. Inorganic materials such as aluminum nitride (AlN), silicon carbide (SiC), and organic materials such as high-thermoconductivity resins, may also be adopted.

In addition, the heat dissipating part 7 also serves to reflect light which is emitted from light emitting elements 3*a*. A portion of the light from the light emitting elements 3*a* is incident upon the heat dissipating part 7 and the portion is reflected at the interface between the supporting parts 4 and 4*a* and the ambient environment. In order to configure the heat dissipating part 7 to also reflect light in this manner, the heat dissipating part 7 may be made of a material with high thermoconductivity and higher light reflectivity than the supporting parts 4 and 4*a*.

Examples of materials having high thermoconductivity and high light reflectivity include metal materials such as aluminum (Al), silver (Ag), copper (Cu), iron (Fe), nickel (Ni), and alloys thereof.

In addition, a reflective layer 20 may be formed on an outer surface of the heat dissipating part 7 between the heat dissipating part 7 and the supporting parts 4 and 4*a*. The reflective layer 20 is utilized to reflect light from the interface between the supporting parts 4 and 4*a* and the ambient atmosphere towards the heat dissipating part 7. The reflective layer 20 may be made of a material with a high light reflectivity. For example, the reflective layer 20 may be made of metal materials such as aluminum (Al), gold (Au), silver (Ag), copper (Cu), palladium (Pd), rhodium (Rh), alloys thereof, organic materials with high reflectivity (for example, such as white paint containing white grains such as titanium oxide, zinc oxide or the like). The reflective layer 20 may be formed by using a plating method, vapor deposition method, sputtering method, etc., to coat the reflective material onto the surface of the heat dissipating part 7. In addition, the reflective layer 20 may be formed using a cladding method to form a layer of reflective material on the surface of the heat dissipating part 7.

The heat dissipating part 7 can be arranged so that it covers the interior surface of the supporting parts 4 and 4*a* and the surface of the substrate part 3*b* which faces the interior surface of the supporting parts 4 and 4*a*. In this case, the heat dissipating part 7 can be arranged to cover the entire interior surface of the supporting parts 4 and 4*a*, or arranged on a portion of the interior surface.

There is no specific restriction on the thickness dimension of the heat dissipating part 7, and it can be altered as necessary.

The region where the heat dissipating part 7 is disposed and the thickness dimension of the heat dissipating part 7 can be determined based on the amount of heat generated from the light emitting elements 3*a*, the configuration and number of the light emitting elements 3*a*, the size of the supporting parts and 4*a*, the environmental conditions under which the illuminating devices 1*c* and 1*d* are used, etc.

For formation of the heat dissipating part 7, for example, the light source part 3 having light emitting elements 3*a* arranged thereon is disposed on the interior surface of the supporting parts 4 and 4*a*, and then the heat dissipating part 7 is formed on the interior surface of the supporting parts 4 and 4*a*.

Also, in forming the heat dissipating part 7, the substrate part 3*b* is bonded on the outer surface of the heat dissipating part 7 so that the light source part 3 is coupled to the heat dissipating part 7, and so that the supporting parts 4 and 4*a* are formed to cover the light source part 3.

In this case, the heat dissipating part 7 may be formed using a plastic processing method, cutting processing method, or other machine processing method.

Illuminating devices 1*c* and 1*d*, like devices 1 and 1*a* facilitate the same improvements related to heat dissipation properties and increasing the light distribution angle.

With regards to illuminating devices 1*c* and 1*d*, the heat dissipating part 7 is disposed on the interior surface of the supporting parts 4 and 4*a*. Consequently, for the illuminating devices 1*c* and 1*d*, the ability of light emitting elements 3*a* to dissipate heat in the direction of the heat dissipating part 7 can be further improved. As a result, for the illuminating devices 1*c* and 1*d*, the light beam emission may be further improved by supplying the light emitting elements 3*a* with larger amounts of electric power. Also, the heat dissipating part 7 when adapted to reflect incident light, or the reflective layer 20 being disposed near the inner surface of supporting parts 4 and 4*a*, may further facilitate increased efficiency in light output by reflecting light from the light emitting elements 3*a* toward ambient environment.

Figure 5:
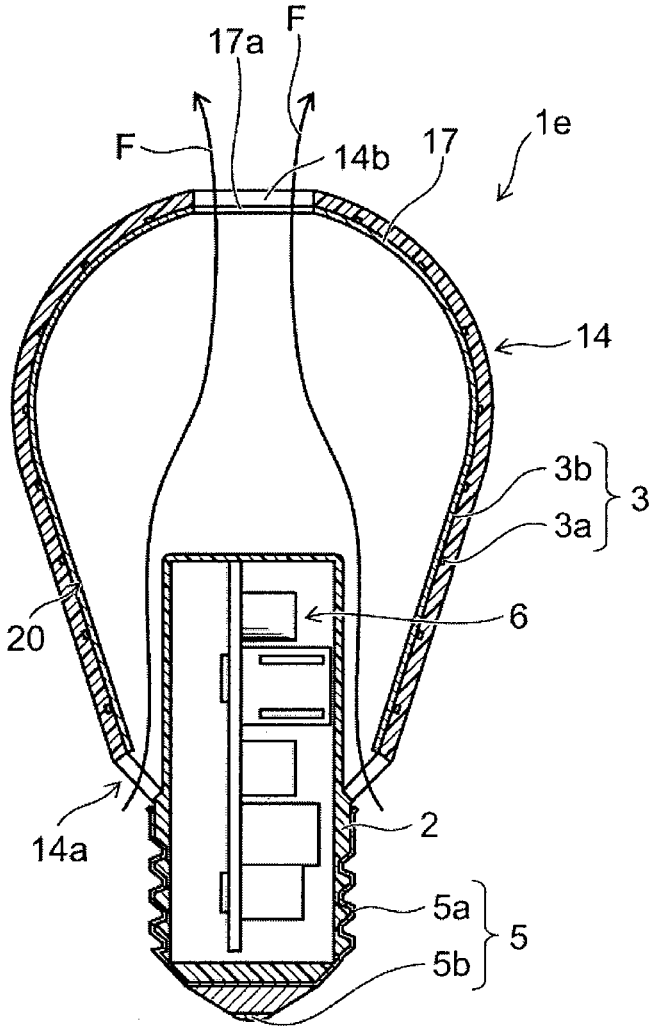
FIG. 5 is a schematic cross-sectional view illustrating an example of the illuminating device according to another embodiment.

FIG. 5 is a schematic cross-sectional view illustrating an example of an illuminating device 1*e* related to another embodiment.

The illuminating device 1*e* shown in FIG. 5 as an example has the same elements as those of the illuminating devices 1*c* and 1*d*.

Here, as previously described in the embodiment of FIG. 3, the supporting part 14 has opening portions 14*a* and opening portion 14*b* formed therein.

Also, an opening portion 17*a* is formed in the heat dissipating part 17. The heat dissipating part 17 is the same as the heat dissipating part 7, with the exception that opening portion 17*a* is formed in heat dissipating part 17.

By means of the opening portion 14*b* formed in the supporting part 14 and the opening portion 17*a* formed in the heat dissipating part 17, the internal space partially enclosed by the supporting part 14 is in communication with the environment external to the illuminating device 1*e*.

Consequently, just as with the illuminating device 1*b* shown in FIG. 3, air flow F may occur without restriction within the supporting part 14. As a result, it is possible to increase the dissipation of heat from the heat dissipating part 17. Also, the air flow direction inside the supporting part 14 changes corresponding to the attachment orientation of the illuminating device 1*e*. For example, as shown in FIG. 5, air may enter through opening portions 14*a* and exit from the opening portion 17*a* and opening portion 14*b*, or air may enter through opening portion 14*b* and opening portion 17*a* and exit through opening portions 14*a*.

For the illuminating device 1*e*, just as in illuminating devices 1 and 1*a*, heat dissipation properties can be improved, and the light distribution angle can be increased.

Also, because heat dissipating part 17 is disposed in the illuminating device 1*e*, similarly to illuminating devices 1*c* and 1*d*, the heat dissipation property of the light emitting elements 3*a* can be improved.

Also, for the illuminating device 1*e*, as opening portion 14*b* and opening portion 17*a* are formed thereon, the air flow F can be formed inside the supporting part 14.

In operation of the illuminating device 1*e*, because of air flow F can occur within the boundaries formed by supporting part 14, the dissipation of heat from the heat dissipating part 17 is enhanced. As a result, in the illuminating device 1*e*, additional electric power can be supplied to the light emitting elements 3*a* in a manner that enhances the light output of the illuminating device 1*e*.

In addition, when the heat dissipating part 17 has the function of reflecting the incident light, or when the reflective layer 20 is formed thereon, it is possible to increase the efficiency in output of light.

Figure 6A:
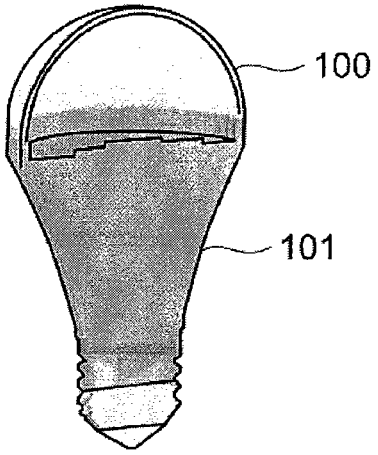
Fig. 6A ( PRIOR ART )
FIGS. 6A to 6C are schematic views which each illustrate an example of the heat dissipation state in an illuminating device.
Figure 6B:
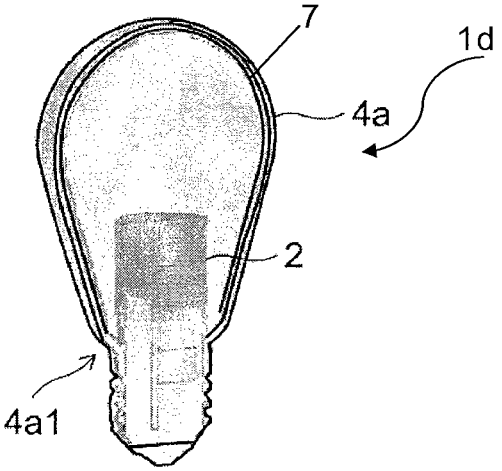
Figure 6C:
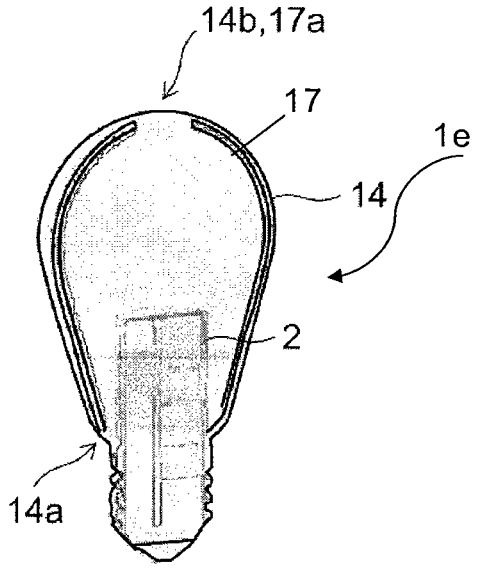

FIGS. 6A to 6C are schematic diagrams illustrating an example of heat dissipation from illuminating devices.

FIG. 6A shows the case of a conventional illuminating device having multiple light emitting elements arranged on an upper end of a substrate 101, and a globe 100 arranged to cover the multiple light emitting elements.

FIG. 6B shows the case of the illuminating device 1*d* having the heat dissipating part 7, as described previously in reference to FIGS. 4A and 4B. FIG. 6C shows the case of the illuminating device 1*e* having the heat dissipating part 7, and opening portions 14*b* and 17*a*, as described previously in reference to FIG. 5.

FIGS. 6A to 6C also illustrate the distribution of temperature of illuminating devices in simulated operations. In this case, the applied electric power is the same in each FIG., and the environmental (i.e., ambient) temperature is about 25 degrees C.

In FIGS. 6A to 6C, the temperature distribution is illustrated by a shading over the depicted area. That is, the higher the temperature, the darker the corresponding shading; and, the lower the temperature, the lighter the corresponding shading.

As shown in FIG. 6A, for a conventional illuminating device, the temperature of the substrate 101 having the light emitting elements arranged on an upper end of a substrate 101 is higher than the temperature of the globe 100. That is, for the conventional illuminating device, the heat generated by the light emitting elements cannot be dissipated with high efficiency, which is undesirable. In this case, usually, because the light emitting elements have a prescribed heat-resistant temperature, if the heat dissipation is poor, the power that can be applied to the elements is limited. Consequently, it is difficult to improve the light output.

As shown in FIG. 6B, for the illuminating device 1*d* having the heat dissipating part 7, although the temperature of the main body part 2 rises, there will be a decrease in temperature of the supporting part 4*a* on which the light emitting elements 3*a* (not shown) are arranged.

That is, it is possible to isolate the heat dissipation route associated with the light emitting elements 3*a* and the heat dissipation route associated with the control part 6.

As mentioned previously, for the illuminating device 1*d*, as the light emitting elements 3*a* are the sources of heat, it is possible to decrease the heat density by dispersing the light emitting elements 3*a* on the supporting part 4*a*.

In addition, for the illuminating device 1*d*, as only a supporting part 4*a* is arranged between the light emitting elements 3*a*, which act as the heating source, and the ambient atmosphere, it is possible to decrease the thermal resistance between the light emitting elements 3*a* and the ambient atmosphere.

Also, for the illuminating device 1*d*, the heat generated by the light emitting elements 3*a* is dissipated outside of the illuminating device 1*d* via the supporting part 4*a*. Consequently, the surface of the supporting part 4*a* serves as the heat dissipating surface.

In addition, for the illuminating device 1*d*, because multiple opening portions 4*a*1 are configured in the first end of supporting part 4*a* adjacent the base part 5, the air within the supporting part 4*a* is in communication with the ambient atmosphere.

Consequently, as shown in FIG. 6B, it is possible to improve the heat dissipation property of the light emitting elements 3*a*. As a result, compared with the conventional illuminating device, the electric power that can be supplied to the light emitting elements 3*a* can be increased, thereby enabling improvement of the light output.

As shown in FIG. 6C, for the illuminating device 1*e* having the heat dissipating part 17, the opening portion 14*b*, and the opening portion 17*a*, it is possible to form an air flow F inside the supporting part 14. Consequently, it is possible to further improve the heat dissipation property on the backside of the light emitting elements 3*a*. As a result, it is possible to increase the supply of electric power that can be applied to the light emitting elements 3*a*, and it is possible to further improve the light output.

In addition, for illuminating device 1*e*, the temperature of the main body part 2 having the control part 6 inside thereof can also be decreased.

According to the embodiments, it is possible to realize an illuminating device that can improve the heat dissipation property. Additionally, light output can be increased due to an increase in electrical power applied to the light emitting elements which is made possible by the increased heat dissipation property of the illuminating devices as described herein.

While certain embodiments have been described, these embodiments have been presented by way of example only, and are not intended to limit the scope of the embodiments. Indeed, the novel embodiments described herein may be embodied in a variety of other forms; furthermore, various omissions, substitutions and changes in the form of the embodiments described herein may be made without departing from the spirit of the embodiments. The accompanying claims and their equivalents are intended to cover such forms or modifications as would fall within the scope and spirit of the embodiments. Further, each of the above embodiments may be performed by being combined mutually.

What is claimed is:

1. An illuminating device comprising:

a base part;

a supporting part having a first end coupled to an end of the base part, the supporting part at least partially enclosing an internal space and having an outer surface thereof exposed to ambient atmosphere;

a plurality of light emitting elements formed on multiple substrate parts disposed on an inner surface of the supporting part, wherein each of the light emitting elements has a light emitting surface in at least partial contact with the supporting part;

a heat dissipating part disposed on an interior side of the supporting part; and a reflective layer configured to reflect light towards the supporting part.

2. The illuminating device of claim 1, wherein the first end of the supporting part includes a plurality of first openings formed therein between the base part and the supporting part, each of the first openings configured to facilitate circulation of air into and out of the internal space.

3. The illuminating device of claim 1, wherein the supporting part includes a second end having a second opening formed therein that is in fluid communication with the plurality of first openings.

4. The illuminating device of claim 1, wherein the plurality of light emitting elements are formed along a longitudinal direction of the supporting part.

5. The illuminating device of claim 1, wherein the supporting part comprises a diffusing member configured to diffuse light emitted by the light emitting elements.

6. The illuminating device of claim 1, wherein the reflective layer is disposed between the heat dissipating part and the supporting part.

* * * * *